US005302185A

United States Patent [19]

Steinleitner

[11] Patent Number: 5,302,185

[45] Date of Patent: Apr. 12, 1994

[54] METHOD FOR THE HANDLING OF ALKALI METALS

[75] Inventor: Günther Steinleitner, Schriesheim, Fed. Rep. of Germany

[73] Assignee: ABB Patnet GmbH, Mannheim, Fed. Rep. of Germany

[21] Appl. No.: 989,228

[22] Filed: Dec. 11, 1992

[30] Foreign Application Priority Data

Dec. 13, 1991 [DE] Fed. Rep. of Germany ..... 4141058

[51] Int. Cl.[5] ..... C22B 9/00

[52] U.S. Cl. ..... 75/592; 222/603

[58] Field of Search ..... 222/603; 75/589, 590, 75/591, 592; 29/623.1, 700

[56] References Cited

U.S. PATENT DOCUMENTS 2,789,047 4/1957 Lemke ..... 75/590
2,810,636 10/1957 Kirk ..... 75/590
5,024,675 6/1991 Stackpool et al. ..... 222/603

FOREIGN PATENT DOCUMENTS 0158409 1/1983 Fed. Rep. of Germany ..... 75/592

*Primary Examiner*—Scott Kastler
*Attorney, Agent, or Firm*—Herbert L. Lerner; Laurence A. Greenberg

[57] ABSTRACT

A method for the handling of alkali metals includes using a protective gas which behaves inertly with regard to the alkali metal within a defined temperature range, and which reacts with the alkali metal to form solid reaction products outside this temperature range.

9 Claims, 1 Drawing Sheet

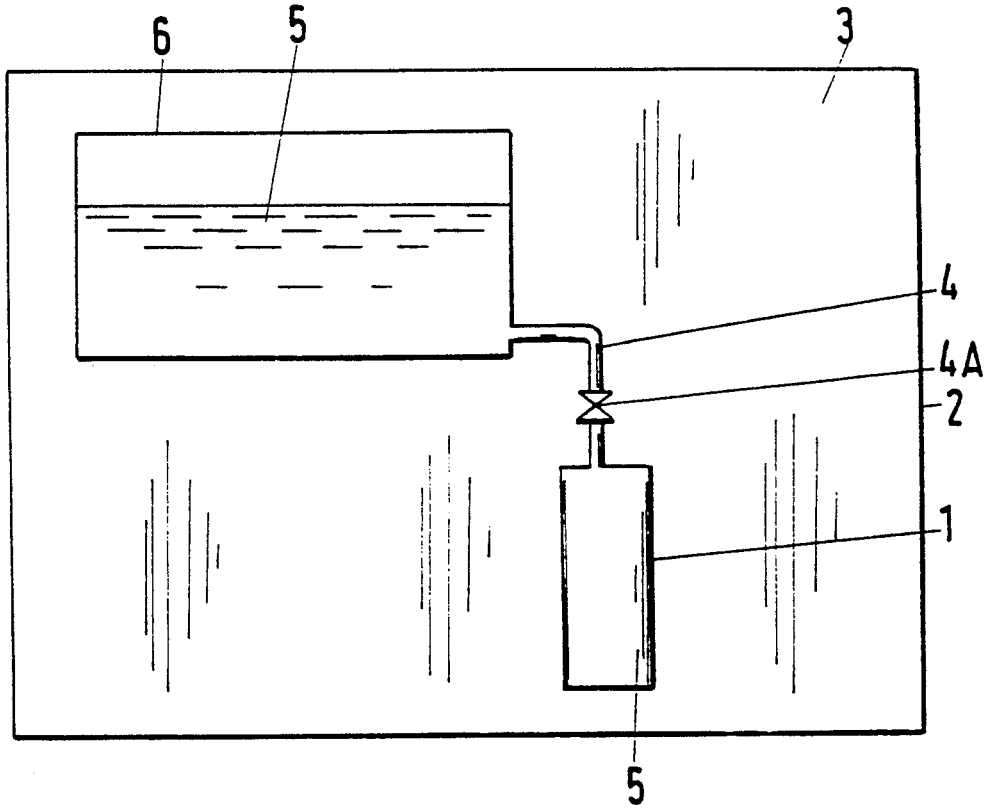
6
5
3
4
4A
2
1
5

METHOD FOR THE HANDLING OF ALKALI METALS

The invention relates to a method for the handling of alkali metals.

Such a method is applied when alkali metals are filled into or transferred between containers and when the metals are stored or subjected to intermediate treatment. Alkali metals, particularly in the liquid state, are very strong reducing agents and therefore they must not be handled in air. Liquid alkali metals are usually handled under a protective gas atmosphere, or under a vacuum using correspondingly more elaborate apparatus. Possible protective gases are primarily noble gases in the form of argon, helium, neon and xenon. In many cases, technical applications may also make use of nitrogen which is cheaper than noble gases. Of the alkali metals, only lithium reacts with nitrogen, and in such a case it is therefore necessary to use one of the above-mentioned noble gases.

When alkali metals are handled under a protective gas atmosphere, which is most commonly a matter of alkali metals being filled into or transferred between containers, inclusions of the inert gas in the alkali metal frequently occur. Firstly, as the alkali metal solidifies, such inclusions give rise to the formation of ga bubbles within the metal. Secondly, the gas is adsorbed on the metal surface, particularly in the case where unwanted, but almost never avoidable, oxide layers are present on the liquid metal. The included or else superficially bound inert gases may interfere when these alkali metals are used for heat transfer or for electricity generation. Thus, for example, the inclusion of gas in sodium which is used in the cooling circuits of reactors may impede heat transfer. The manufacture of fusedelectrolyte or high-temperature storage batteries on the basis of sodium and sulphur similarly makes use of nitrogen for the formation of the sodium electrode. In this case, filling the sodium into cartridges, which was heretofore carried out under a protective gas atmosphere of nitrogen, may give rise to inclusions of nitrogen in the sodium and to the adsorption of the nitrogen on the metal surface. The inert gas thus introduced results in a reduction of the active surface of the solid electrolyte in such storage cells. As a result, the internal resistance of the storage cell is increased, and the targeted current flow is reduced.

It is accordingly an object of the invention to provide a method for the handling alkali metals, which overcomes the hereinafore-mentioned disadvantages of the heretofore-known methods of this general type, and which does so while precluding the interfering effects of such protective gases.

With the foregoing and other objects in view there is provided, in accordance with the invention, a method for the handling of alkali metals, which comprises handling alkali metals in a protective gas which behaves inertly with regard to the alkali metal within at least one defined temperature range, and which reacts with the alkali metal to form solids or passes into solution in remaining or other temperature ranges within which the alkali metal is used.

Using a protective gas in the form of carbon dioxide, carbon monoxide or a protective gas which essentially is formed of one of these gases or of a mixture of these gases, overcomes all of the known drawbacks which occur when nitrogen is used as a protective gas. Sodium is filled into containers preferably at a temperature of from 100° to 130° C. The melting point of the metal is at 97°. Carbon dioxide and carbon monoxide are protective gases which behave inertly with regard to the alkali metal, in particular to sodium, in this temperature range. At temperatures of 300° C. and higher, at which the sodium present in a fused-electrolyte storage cell is used for the generation of electricity, a reaction of carbon dioxide or carbon monoxide with sodium may occur. However, no gaseous reaction products are produced, but only small quantities of solid reaction products which do not affect the functioning of the fused-electrolyte storage cell. Should such small amounts of solids being formed cause problems after all, it is possible to remove the substances by means of the cold trap technique that is usually applied in reactor technology. In addition to such positive properties shown by carbon dioxide and carbon monoxide during filling into or transferring between containers and in the use of the alkali metals in industrial processes, the gases are also more suitable for special applications than an inert gas, in the case of the storage of solid alkali metals filled into containers. Alkali metals in a solid state similarly adsorb inert gases in the surface region, particularly on the oxide layers, when they also come into contact with the inert gas. That is avoided if carbon monoxide or carbon dioxide has already bound to such sites. The adsorption of inert gas during storage or subsequent further processing of the alkali metal is thus precluded.

Instead of filling into containers under a protective gas atmosphere of carbon dioxide or carbon monoxide, this can also be done as before under a protective gas atmosphere of nitrogen or noble gases. According to the invention, nitrogen which is adsorbed on the surface of alkali metals, or which is included between the surface of the alkali metal and the wall of the container holding the alkali metal, can be exchanged by prolonged evacuation and flushing with carbon dioxide or carbon monoxide. This is readily achieved, for example, in the case of cartridges containing sodium for fused-electrolyte storage cells, prior to the cartridges being loaded into the fused-electrolyte storage cell. In this case it is expedient to evacuate the sodium-filled cartridges above the melting point of this alkali metal, in order to remove included nitrogen bubbles. In this case as well, the nitrogen is exchanged with carbon monoxide or carbon dioxide, in order to preclude the adsorption of a gas adversely affecting the properties of the sodium even at a later time.

In accordance with another mode of the invention, there is provided a method which comprises filling, transferring, storing or intermediately treating the alkali metal in a protective gas being inert in the region of the melting point of the alkali metal.

In accordance with a further mode of the invention, there is provided a method which comprises filling, transferring, storing or intermediately treating the alkali metal in a protective gas atmosphere being selected from the group consisting of carbon dioxide and a gas having carbon dioxide as an essential component.

In accordance with an added mode of the invention, there is provided a method which comprises filling, transferring, storing or intermediately treating the alkali metal in a protective gas atmosphere being selected from the group consisting of carbon monoxide and a gas having carbon monoxide as an essential component.

In accordance with an additional mode of the invention, there is provided a method which comprises filling, transferring, storing or intermediately treating the alkali metal in a protective gas atmosphere being selected from the group consisting of carbon monoxide and carbon dioxide together and a gas having carbon monoxide and carbon dioxide as essential components.

With the objects of the invention in view, there is also provided a method for the handling of alkali metals, which comprises filling an alkali metal into containers in an atmosphere selected from the group consisting of nitrogen and a noble gas, and replacing gas bubbles included during the filling step or gas binding to the surface of the metal during the filling step, prior to use in reactors and fusedelectrolyte storage batteries, with a gas selected from the group consisting of carbon monoxide and carbon dioxide.

With the objects of the invention in view, there is additionally provided a method for the handling of sodium, which comprises handling sodium in a protective gas selected from the group consisting of carbon dioxide, carbon monoxide, gas having carbon dioxide as an essential component, and gas having carbon monoxide as an essential component by filling, transferring, intermediately treating or storing the sodium in cartridges of fused-electrolyte storage cells.

Other features which are considered as characteristic for the invention are set forth in the appended claims.

Although the invention is illustrated and described herein as embodied in a method for the handling of alkali metals, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The drawing is a a diagrammatic, elevational view of a device for carrying out the method according to the invention.

Referring now to the single figure of the drawing in detail, there is seen a cartridge 1 which is to be filled with sodium and which is to be subsequently fitted into a non-illustrated electrochemical storage cell. To this end, the cartridge 1 is placed in a filling chamber 2 which is filled with carbon dioxide, carbon monoxide or a mixture of the two gases, as is indicated by reference numeral 3. Sodium 5 is filled from a storage vessel 6 containing the sodium 5 into the interior of the cartridge 1 through a pipe 4, having a through-flow rate that can be controlled by a valve 4A. The cartridge 1 is subsequently sealed and it can then be stored until it is used in a non-illustrated fused-electrolyte or high-temperature storage cell. According to the invention, the filling chamber 2 can also be filled with nitrogen as the protective gas. In order to preclude the drawbacks of nitrogen, prior to being loaded into a non-illustrated fused-electrolyte storage cell, the cartridge 1 is evacuated at the melting point of the sodium 5 in order to remove the included nitrogen bubbles and to replace the nitrogen adsorbed on the surface of the metal with carbon dioxide or carbon monoxide.

I claim:

1. In a method of handling alkali metals, wherein the alkali metals are intermediately treated and filled into containers, the improvement which comprises:

intermediately treating and filling an alkali metal into a container in a defined temperature range and in a protective gas atmosphere selected from the group consisting of carbon dioxide, carbon monoxide and a gas having carbon dioxide and carbon monoxide as an essential component and which behaves inertly with regard to the alkali metal in the defined temperature range and which reacts with the alkali metal to form solids or passes into solution in a temperature range outside the defined temperature range.

2. The method according to claim 1, which comprises filling the alkali metal into containers in a protective gas being inert in the region of the melting point of the alkali metal.

3. The method according to claim 1, which comprises transferring the alkali metal between containers in a protective gas being inert in the region of the melting point of the alkali metal.

4. The method according to claim 1, which comprises storing the alkali metal in containers in a protective gas being inert in the region of the melting point of the alkali metal.

5. The method according to claim 1, which comprises intermediately treating the alkali metal in a protective gas being inert in the region of the melting point of the alkali metal.

6. In a method of handling sodium, wherein the sodium is filled into a container of a high-temperature sodium sulfur storage cell, the improvement which comprises: filling the sodium into the container within a defined temperature range and in a protective gas atmosphere selected from the group consisting of carbon dioxide, carbon monoxide and a gas having dioxide and carbon monoxide as an essential component and which behaves inertly with regard to the sodium in the defined temperature range and which reacts with the sodium to form solids or passes into solution at a temperature in which the sodium is used in a high-temperature sodium/sulfur storage cell.

7. A method for the handling of alkali metals, which comprises filling an alkali metal into a container in a protective gas atmosphere selected from the group consisting of nitrogen and a noble gas, and replacing gas bubbles included during the filling step or gas binding to the surface of the metal during the filling step, prior to use in reactors or high-temperatures sodium/sulfur storage cells, with a gas selected from the group consisting of carbon monoxide, carbon dioxide and a gas having carbon dioxide and carbon monoxide as an essential component.

8. The method according to claim 7, which comprises filling sodium into a container in the filling step.

9. The method according to claim 8, which comprises, subsequently to the replacing step, placing the container filled with the sodium in a high-temperature sodium/sulfur storage cell.

* * * * *